United States Patent [19]

Huber et al.

[11] Patent Number: 4,516,284

[45] Date of Patent: May 14, 1985

[54] BRIDGING ARRANGEMENT FOR EXPANSION JOINTS IN THE CARRIAGEWAYS OF BRIDGES OR THE LIKE

[75] Inventors: Reinhold Huber, Bulach, Switzerland; Waldemar Koster, Forsbach, Fed. Rep. of Germany

[73] Assignee: Kober AG, Glarus, Switzerland

[21] Appl. No.: 481,643

[22] Filed: Apr. 4, 1983

[30] Foreign Application Priority Data

Apr. 5, 1982 [DE] Fed. Rep. of Germany ..... 3212717

[51] Int. Cl.[3] ..... E01D 19/06; E01C 11/12

[52] U.S. Cl. ..... 14/16.5; 404/56; 52/573

[58] Field of Search ..... 14/16.5; 404/69, 68, 404/56, 57, 58, 59; 52/396, 573

[56] References Cited

U.S. PATENT DOCUMENTS

| | | | |
|---|---|---|---|
| 3,604,322 | 9/1971 | Koster | 14/16.5 X |
| 3,698,292 | 10/1972 | Koester | 14/16.5 X |
| 4,030,156 | 6/1977 | Raymond | 14/16.5 |
| 4,075,728 | 2/1978 | Puccio | 14/16.5 |

FOREIGN PATENT DOCUMENTS

| | | | |
|---|---|---|---|
| 1658611 | 10/1970 | Fed. Rep. of Germany | . |
| 2004634 | 9/1971 | Fed. Rep. of Germany | 14/16.5 |
| 2112218 | 10/1972 | Fed. Rep. of Germany | 14/16.5 |
| 2210214 | 9/1973 | Fed. Rep. of Germany | 14/16.5 |
| 2402745 | 8/1974 | Fed. Rep. of Germany | 14/16.5 |
| 2746490 | 4/1979 | Fed. Rep. of Germany | 14/16.5 |
| 3019594 | 11/1981 | Fed. Rep. of Germany | . |
| 1557598 | 1/1969 | France | 14/16.5 |

*Primary Examiner*—James A. Leppink
*Assistant Examiner*—Beverly E. Hjorth

[57] ABSTRACT

In the case of a bridging arrangement for expansion joints in the carriageways of bridges or the like having a plurality of parallel plates (1–5) which are adjacent to the surface of the carriageway, run at right-angles to the direction of the carriageway and are supported on bars (6–10) which bridge the joint gap and are displaceably mounted in the edges (14, 15) of the joint, each plate is rigidly connected to two or more bars, but each bar is rigidly connected to not more than one plate. The spacings of the plates is controlled by means of elastomeric bearing members (19), the bars being supported by bearing members of that type that are on one or both of the plates and the two outer bars being supported likewise by bearing members of that type which are on the two edges (14, 15) of the joint, each on a different edge. This type of arrangement of the bearing member described results additionally in an especially even distribution of the vertical loads.

5 Claims, 4 Drawing Figures

BRIDGING ARRANGEMENT FOR EXPANSION JOINTS IN THE CARRIAGEWAYS OF BRIDGES OR THE LIKE

The invention relates to a bridging arrangement for expansion joints in the carriageways of bridges or the like. Bridging arrangements are known in which a plurality of parallel plates are adjacent to the surface of the carriageway, run at right-angles to the direction of the carriageway and are supported on bars which bridge the joint gap displaceably mounted in the edges of the joint. In these arrangements, each plate is rigidly connected to two or more bars but each bar is rigidly connected to not more than one plate, and elastomeric members being provided which act on the bars to control the spacings of the plates.

An arrangement of the foregoing type is known from German Auslegeschrift 1 658 611 which corresponds to U.S. Pat. No. 3,604,322 which issued to the applicant herein. In that publication, each plate is rigidly connected to at least two bars, that is to say mounted on the bars so that it is stable. The bars in turn are mounted in the two edges of the joint so that they are longitudinally displaceable, the displacement path being determined by elastomeric members by means of which the bars are shear-deformably connected to one another and to the two edges of the joint. In this arrangement, the shear-deformable elastomeric members are connected laterally to the bars; to secure these elastomeric members in position, fastening means are additionally required; if the joint assumes a skewed position, for example owing to longitudinal displacement of the edges of the joint, the shear-deformable bearing members are additionally loaded perpendicular to the direction of shear, which, in its turn, has a disadvantageous effect on the distribution of the shear force.

In the case of another known solution (German Offenlegungsschrift 30 19 594 and U.S. Pat. No. 3,698,292 of the applicant), each of the bars, or short part bars, is accommodated in openings of a plurality of plates, with the aim of achieving an especially favourable distribution of the vertical loads and a high load-bearing capacity for the whole structure. Owing to shear-deformable elastomeric bearing members that are arranged in the region of the opening, it is possible, at the same time, to control the plates in the region of the joint in such a manner that the plates are arranged across the width of the joint always at the same spacings from one another and from the edges of the joint. A prerequisite for achieving the desired effects is, in this case, a special manner of construction in which the plates form openings through which the bars are passed.

In contrast, the problem underlying the present invention is to improve a bridging arrangement for joints of the type mentioned in the introduction in such a manner that, in addition to a simplification of the mounting and bearing of the arrangement in the edges of the joint, an especially uniform distribution of vertical loads is achieved.

This problem is solved according to the invention in that, to control the spacings of the plates, the majority of the plates are supported on the bars by shear-deformable elastomeric bearing members, such shear-deformable members supporting one or both of the plates adjacent to the plate rigidly connected to the bar, the two outer bars, that is the first and the last bar being likewise supported by shear-deformable elastomeric bearing members at at least one end thereof, each at an opposing end.

With this proposed solution, two things are achieved by the element of the shear-deformable bearing member, namely, firstly, a considerable enlargement of the effective supporting load in the vertical direction of the plates and the bars lying below them and, secondly, control of the spacing of the plates.

Owing to the fact that the plates bend under vertical loads, the shear-deformable bearing members, in addition to the rigid connecting places, act as additional vertical supports between the plates and bars, which results in a very advantageous evening out of the distribution of vertical loads in the whole region of the joint.

The shear-deformable bearing members can undertake control functions both in the case of a narrowing of the joint and also in the case of a widening of the joint or in the case of a displacement of the plates caused by wheel load.

The structural arrangement disclosed may be fixed in the edges of the joint especially simply, since here also the same shear-deformable bearing members can be used for supporting the ends of the bars.

The shear-deformable bearing members can be secured in position in an especially simple manner owing to its vertical restraint; mounting of such bearing members under vertical pressure pre-stress between plates and bars does not require additional expenditure for special mounting devices.

Two embodiments of the invention are explained below with reference to the drawings.

Figure 1:
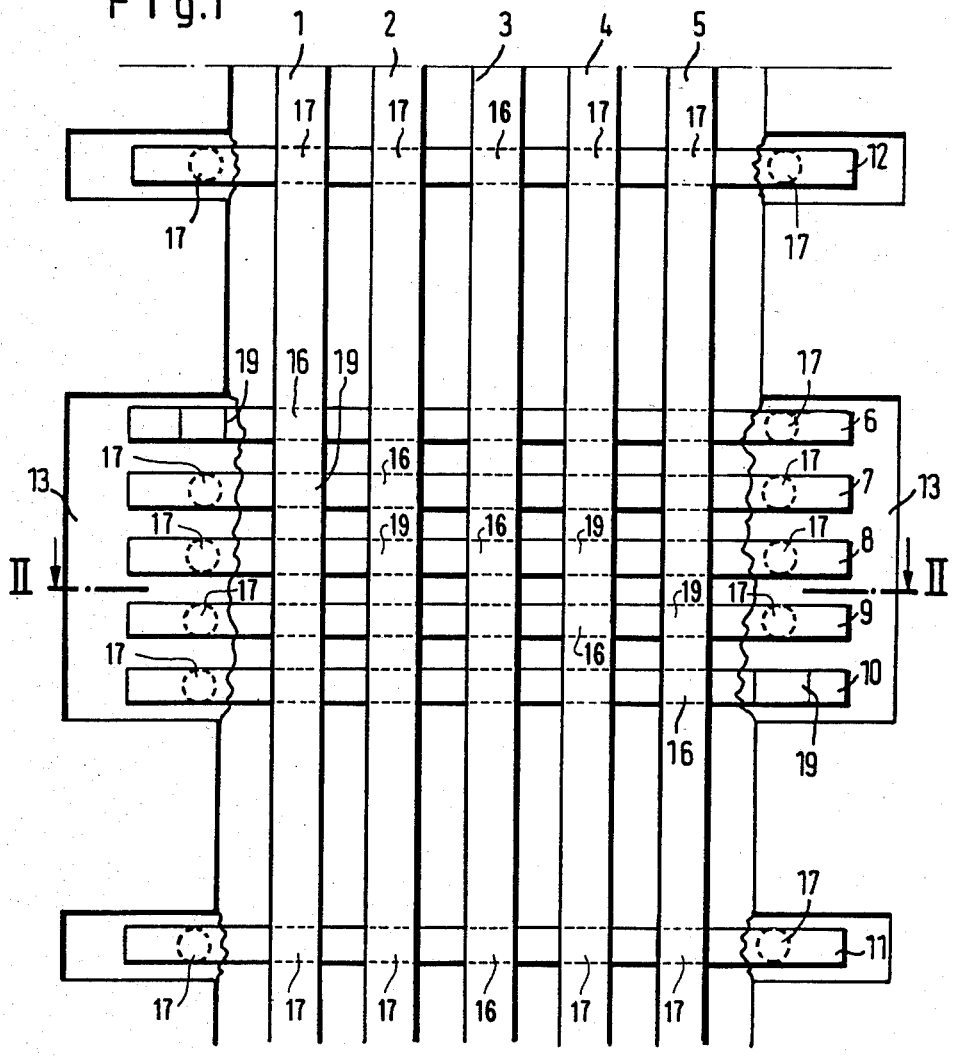
FIG. 1 shows a schematic plan view of a bridging device for joints.

FIG. 1 shows a bridging device for joints having five plates 1–5. There are arranged below the plates bars, of which five bars 6–10 are joined together to one bearing place 13 which is characterised by recesses 14*a*, 14*b* respectively in the edges 14, 15 of the joint. Furthermore, two sliding bars 11, 12 are shown which are arranged at a distance from, and on both sides of, the bearing place 13. Overall, there is shown only a small portion of the plates 1–5 which are arranged in the region of the joint, run at right-angles to the carriageway and are flush therewith. In a useful embodiment, the distance between a sliding bar and an adjacent bearing place 13, measured up to the centre of the bearing place, is about 2 meters. In addition to the vertical load to be taken up, this spacing depends on the dimensions of the plates.

Bearing elements 16 for the rigid connection between plates and bars are indicated by cross-hatching. The bearing elements 16 are preferably steel members which are welded on the one hand to the underside of the plate in each case and, on the other hand, to the upper side of the associated bar. The central plate 3 is rigidly connected via a bearing element 16 of that type to the bar 8 in the region of the bearing place 13; furthermore, the central plate 3 is also rigidly connected to the two sliding bars 11, 12. In this manner there is a lateral control of the sliding bars 11, 12, with the result that the central plate 3 is always held in a central position with respect to the joint gap.

The connection places in the form of circles in the plan view represent sliding members 17 which make possible a sliding support of the plates 1–5 on the bars or a sliding support of the ends of the bars in the region of the edges of the joint.

Figure 2:
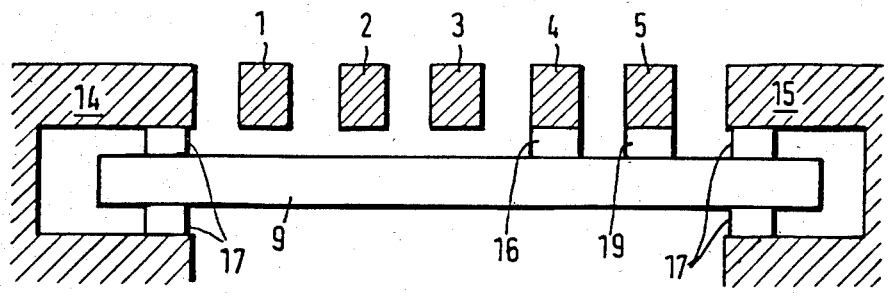
FIG. 2 shows a vertical cross-section according to II—II of FIG. 1.

FIG. 2 shows the arrangement, for each edge of the joint, of two sliding members 17 on the two sides of the bar 9, the sliding members 17 preferably being built in so that they are vertically pre-stressed. The plate 5 at one side of the edge of the joint is supported on the bar 9 via a shear-deformable bearing member 19. The adjacent plate 4 is rigidly connected to the bar 9 by means of a rigid, non-deformable bearing element 16. The remaining plates 1–3 are spaced along the bar 9. The shear-deformable bearing members 19 serve, on the one hand, to control the spacing of the plates 1–5 and, on the other hand, as additional bearing places for carrying vertical loads.

For simplification of the representation, sealing sections between the plates and the edges of the joint have been omitted from the drawings. Instead of the two sliding bars 11, 12, it is equally possible to provide repeatedly a support for the plates that is similar to the support in the region of the bearing place 13.

The bearing members 19 consist of shear-deformable elastomeric material; they are rigidly connected, on the one hand, to the underside of the plates and, on the other hand, to the upper side of the bars. A change in width of the joint results in shear deformation of the shear-deformable bearing member 19 so that restoring forces are produced which are transmitted from the bars via the bearing members 19 to the plates connected thereto. One end of each of the two outer bars 6, 10 of the bearing place 13 is supported likewise by means of shear-deformable bearing members 19 in the opposed edges of the joint.

Figure 3:
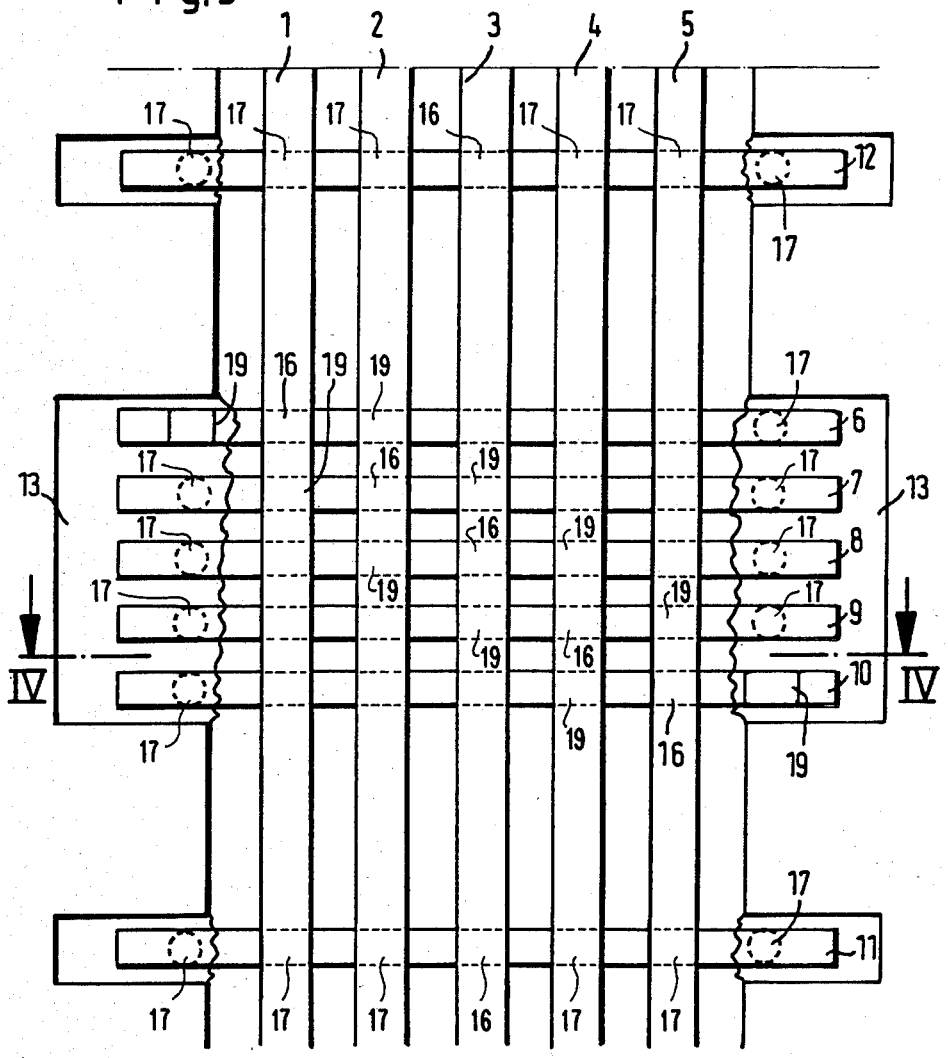
FIG. 3 shows a schematic plan view of a variant of the bridging device for joints according to FIG. 1.
Figure 4:
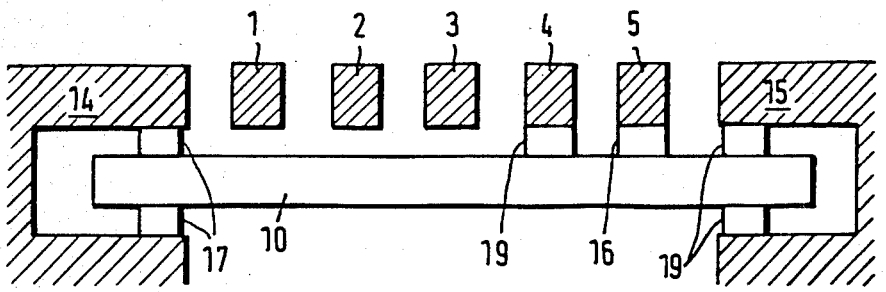
FIG. 4 shows a vertical cross-section according to IV—IV of FIG. 2.

FIGS. 3 and 4 show a variant of the bridging arrangement according to FIGS. 1 and 2, the variant being provided merely with some additional shear-deformable bearing members 19, in such a manner that each bar is connected rigidly to one plate and via shear-deformable bearing members 19 to two adjacent plates or to one adjacent plate and to one edge of the joint. The representation according to FIG. 4 shows this type of connection by means of an outer bar 10, the right-hand end of the bar being clamped vertically between bearing members 19 lying against the upper and lower side, while the left-hand end of the bar is supported, so that it can slide, between sliding members 17 lying against the upper and lower side. The plate 5 at one side of the edge of the joint is rigidly connected to the bar 10 via rigid bearing element 16. The adjacent plate 4 is connected to the bar 10 via an elastomeric bearing member 19.

What is claimed is:

1. Bridging arrangement for an expansion joint in a carriageway of a bridging structure and the like, wherein the expansion joint is located between edges of adjacent construction members formed with facing recesses, said construction members being spaced apart in the direction of said carriageway and said recesses therein extending in a direction transverse to said carriageway, a plurality of longitudinally extending bars, spaced from one another in said direction transverse to said carriageway, bridging said construction members and extending into said recesses thereof, a first plurality of slide support means in one of said recesses for all but one of said plurality of bars for slidably supporting the ends of said all but one bar in said one of said recesses, a second plurality of slide support means in the other of said recesses for all but one of said plurality of bars for slidably supporting the ends of all but one bar in said other of said recesses, a plurality of spaced apart plates adjacent the surface of the carriageway and extending longitudinally in a direction transverse to the direction of said carriageway solely above and spaced from said bars, each of said plates, to ensure uniform spacing between the plates and adequate support thereof for sustaining heavy vertical loads, having at least one rigid connection between the plates and said bars, and for at least a majority of said plates, at least one additional connection to said bars by a shear-deformable elastomeric member provided between the lower surface of the plate and the upper surface of the bar, said one of said plurality of bars in said one and in said other of said recesses being different bars connected at at least one end thereof to a shear-deformable elastomeric member.

2. The bridging arrangement of claim 1, wherein said one of said plurality of bars in said one and in said other of said recesses comprise the outermost of said plurality of bars and comprising the first and last of said plurality of bars, said shear-deformable elastomeric member connection to the first of the plurality of bars being at an end opposite the end at which connection is made of said shear-deformable elastomeric member to the last of the plurality of bars.

3. The bridging arrangement of claim 2 wherein all but one plate has at least one shear-deformable elastomeric member connection to said bars.

4. The bridging arrangement of claim 1, wherein the majority of said plurality of plates have at least two shear-deformable elastomeric member connections to said plurality of bars.

5. The bridging arrangment of claim 4, wherein said rigid connection is made with steel members welded at one of its ends to the underside of the plate and at its opposite end to the upper surface of the associated bar.

* * * * *